United States Patent [19]

Manning

[11] Patent Number: 4,930,331

[45] Date of Patent: Jun. 5, 1990

[54] APPARATUS AND METHOD FOR FABRICATING ELLIPTICAL TUBING

[76] Inventor: Douglas E. Manning, 7300 Rule Rd., SW., Knoxville, Tenn. 37920

[21] Appl. No.: 315,284

[22] Filed: Feb. 24, 1989

[51] Int. Cl.[5] ..... B21D 7/00

[52] U.S. Cl. ..... 72/396; 72/367; 72/416; 72/392

[58] Field of Search ..... 72/396, 398, 392, 416, 72/412, 367, 370, 368, 353, 360; 29/157 R, 157.3 R

[56] References Cited

U.S. PATENT DOCUMENTS

| | | | |
|---|---|---|---|
| 408,059 | 7/1889 | Wilmot | 72/368 |
| 563,797 | 7/1896 | Peters | 72/396 |
| 1,319,837 | 10/1919 | Brinkman | 72/416 |
| 2,841,865 | 7/1958 | Jackson | 72/360 |
| 4,467,511 | 8/1984 | Collgon | 72/367 |

FOREIGN PATENT DOCUMENTS

| | | | |
|---|---|---|---|
| 473109 | 4/1951 | Canada | 72/370 |
| 86030 | 5/1986 | Japan | 72/416 |

*Primary Examiner*—Daniel C. Crane
*Attorney, Agent, or Firm*—Pitts and Brittian

[57] ABSTRACT

An apparatus (10) and method for fabricating metal tubing of generally elliptical shape by cold pressing round tubing stock into the desired shape. The apparatus (10) includes a first pair of opposing dies (16 and 18) secured to the platens (12and 14) of a press for forming the substantially flattened sides of the tubing. A second pair of opposing dies, positioned substantially between and on either side of the first pair of dies, is provided for forming the substantially rounded sides of the elliptical tubing. Means (52) for providing a preselected rate of resistance to movement of the second pair of opposing dies as they are engaged by the substantially rounded sides of the tubing, such that the tubing can be pressed into the desired substantially elliptical shape defined by the die faces of the first and second pairs of opposing dies by operating the press to move the platens (12 and 14) toward one another, are provided.

9 Claims, 4 Drawing Sheets

APPARATUS AND METHOD FOR FABRICATING ELLIPTICAL TUBING

TECHNICAL FIELD

This invention relates to an apparatus and method for fabricating metal tubing having a generally elliptical cross-sectional shape, and in particular to an apparatus and method for pressing round tubing stock into the desired shape.

BACKGROUND ART

The fabrication of metal tubing of rigid alloys such as steel having a generally elliptical shape poses certain problems. Although tubing of various shapes, including elliptical, can be formed by heating round tubing to a high temperature and working it into the desired shape while heated, this method is excessively costly and time consuming. It is also possible to form round tubing stock into the desired shape by pressing it in a conventional press having two dies as illustrated in FIG. 2; however, to do so requires many successive stages because of a problem discussed below. Accordingly, this method is difficult and time consuming and therefore very expensive.

It is desirable to be able to fabricate tubing having the generally elliptical shape illustrated in FIGS. 1A and 1B by pressing round tubing stock into the desired shape. It will be noted that FIG. 1A represents the cross-sectional shape of tubing which is generally elliptical with substantially flattened sides 103A and 103B which have a radius of curvature which is much greater than that of the round tubing stock from which it could be fabricated as well as the radius of curvature of its substantially rounded sides 104A and 104B, and FIG. 1B represents the cross-sectional shape of generally elliptical tubing in which the flattened sides 101A and 101B are essentially completely flattened with no curvature at all. While it would appear to one of ordinary skill in the art that tubing of the shape illustrated in FIGS. 1A, for example, could be fabricated by pressing round tubing stock between dies having the shape illustrated by those shown at 201 and 202 in FIG. 2, experimental efforts to do this have proved unsuccessful unless performed in an excessive number of stages. When round tubing stock is pressed between two dies having the same general shape as those illustrated at 201 and 202 in FIG. 2, instead of taking the shape defined by the dies, the tubing is initially pressed into the egg shape shown in FIG. 1C and then into the football shape shown in FIG. 1D until the distance w' between the points 120 and 122 on the tubing exceeds the distance shown by the arrows w shown in FIG. 2. This can occur before the surfaces 204 and 206 of the dies 201 and 202, respectively, (in FIG. 2) meet, thereby causing the tubing to crinkle at the points 120 and 122 (in FIG. 1D) before it can be pressed into the shape defined by the dies. This problem is particularly exacerbated when the desired elliptical shape is substantially elongated. The present invention is directed to an apparatus and method for fabricating tubing having the same general shape as that shown in FIGS. 1A or 1B which solves the aforementioned problem of crinkling of the tubing proximate the substantially rounded sides of the tubing when round tubing stock is being pressed into the desired shape.

As used herein, the term "substantially flattened sides" refers to the sides of the tubing fabricated using the present invention which are substantially flattened as shown generally at 101A and 101B in FIG. 1B, or have a radius of curvature which is much larger than that of the round tubing from which it is fabricated, as shown at 103A and 103B in FIG. 1A. The term "substantially rounded sides" refers to the sides of the tubing fabricated using the present invention which are substantially rounded as shown generally at 104A/B and 102A/B in FIGS. 1A and 1B, respectively.

Therefore, it is a primary object of the present invention to provide an apparatus and method for fabricating metal tubing of generally elliptical shape by cold pressing round tubing stock into the desired shape using a press.

It is a further object of the present invention to provide an apparatus for fabricating metal tubing of generally elliptical shape which can be used in conjunction with a press of conventional design having a stationary platen and a moving platen.

It is another object of the present invention to provide an apparatus and method for fabricating metal tubing of generally elliptical shape by pressing round tubing stock into the desired shape which is relatively simple and inexpensive to construct and use.

DISCLOSURE OF THE INVENTION

Other objects and advantages will be accomplished by the present invention which provides an apparatus and method for fabricating metal tubing of generally elliptical shape by pressing round tubing stock into the desired shape. The apparatus of the present invention comprises a first pair of opposing dies having die faces of preselected shape for forming the substantially flattened sides of tubing of generally elliptical shape. The first pair of dies are secured to first and second opposing platens of a press. A second pair of opposing dies having die faces which define a preselected substantially concave shape for forming the substantially rounded sides of the elliptical tubing are provided. The second pair of opposing dies are positioned substantially between and on either side of the first pair of opposing dies such that when a length of round tubing stock is pressed between the first pair of dies, the substantially rounded sides of the tubing, which are disposed at right angles to the substantially flattened sides which have been engaged by the first pair of dies, are displaced outward and engage the die faces of the second pair of opposing dies. Means for providing a preselected rate of resistance to the movement of the second pair of opposing dies as they are engaged by the substantially rounded sides of the tubing stock, such that the stock is pressed into the desired substantially elliptical shape defined by the die faces of the first and second pairs of opposing dies, are provided.

In the preferred embodiment, the second pair of opposing dies comprise a pair of plates which define die faces and are pivotable about a pivot axis which is parallel to the die faces and is located proximate an edge of the plate opposite the die face edge. As the round tubing stock is pressed between the first pair of opposing dies, the tubing stock engages the die faces of the second pair of opposing dies which pivot as the tubing is further pressed into the desired shape. Means for securing the second pair of opposing dies in a position such that forces on them which are perpendicular to the pivot axes are absorbed without substantially displacing the dies outward away from the tubing stock are provided.

BRIEF DESCRIPTION OF THE DRAWINGS

The above-mentioned features of the present invention will become more clearly understood from the following detailed description of the invention read together with the drawings in which.

BEST MODE FOR CARRYING OUT THE INVENTION

An apparatus incorporating various features of the present invention is illustrated generally at 10 in the figures. The apparatus 10 is used in conjunction with a press having opposing platens 12 and 14. In the embodiment illustrated in the figures, the platen 12 is a moving platen which is connected to a ram (not shown) and the platen 14 is stationary. It will be appreciated by those skilled in the art, however, that both platens could be moving platens, each of which would be connected to a ram.

Figure 1A:
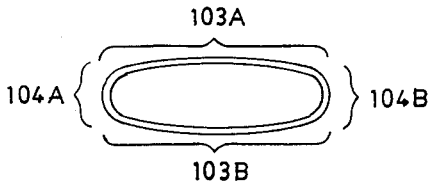
FIG. 1A illustrates a cross-sectional view of substantially elliptically shaped tubing which can be fabricated by the apparatus and method of the present invention in which the substantially flattened sides of the tubing have a radius of curvature which is much greater than the radius of curvature of the substantially rounded sides of the tubing.
Figure 1C:
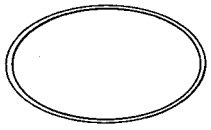
FIG. 1C illustrates a cross-sectional view of tubing as it would appear at an intermediate step of fabrication.
Figure 1B:
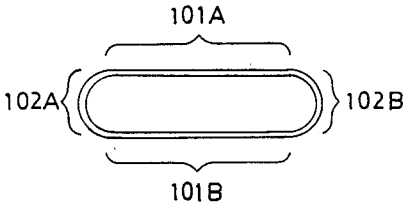
FIG. 1B illustrates a cross-sectional view of tubing which can be fabricated by the apparatus and method of the present invention in which the substantially flattened sides of the tubing are completely flattened and have an essentially infinite radius of curvature.
Figure 1D:
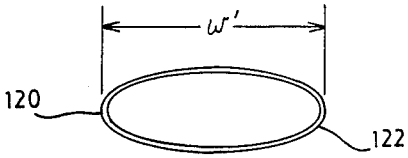
FIG. 1D illustrates a cross-sectional view of tubing which illustrates a problem associated with fabrication of tubing when round tubing is pressed between the dies illustrated in FIG. 2.
Figure 2:
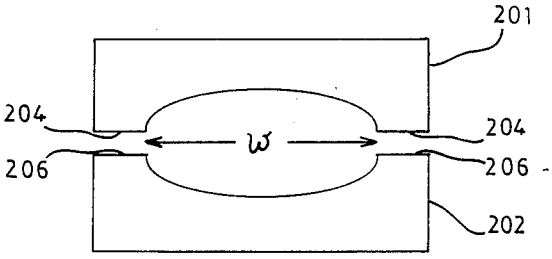
FIG. 2 (PRIOR ART)
FIG. 2 illustrates a cross-sectional view of a pair of opposing die faces which have been used in a prior effort to construct an apparatus for fabricating tubing having a generally elliptical shape.

Referring to FIGS. 3–6, the apparatus 10 includes a first pair of opposing dies 16 and 18 which define die faces 20 and 22, respectively, for forming the substantially flattened sides (illustrated at 103A/B and 101A/B in FIGS. 1A and 1B) of metal tubing having a generally elliptical shape as shown in FIGS. 1A and 1B. A second pair of opposing dies 24 and 26 which define substantially concave die faces 28 and 30, respectively, are provided for forming the substantially rounded sides (illustrated at 102A/B and 104A/B in FIGS. 1A and 1B) of metal tubing having a generally elliptical shape as shown in FIGS. 1A and 1B.

Figure 4:
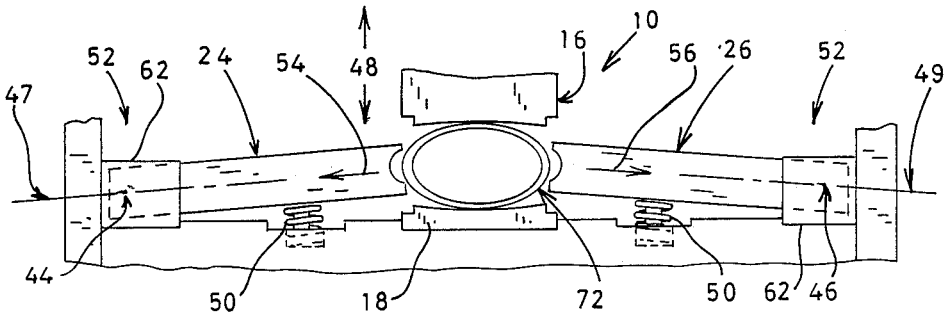
FIG. 4 illustrates an end view of an apparatus for fabricating metal tubing having a generally elliptical shape by cold pressing round tubing stock into the desired shape, constructed in accordance with the various features of the present invention. This figure shows the apparatus as it appears at the point where the second pair of dies of the present invention engage the tubing.
Figure 5:
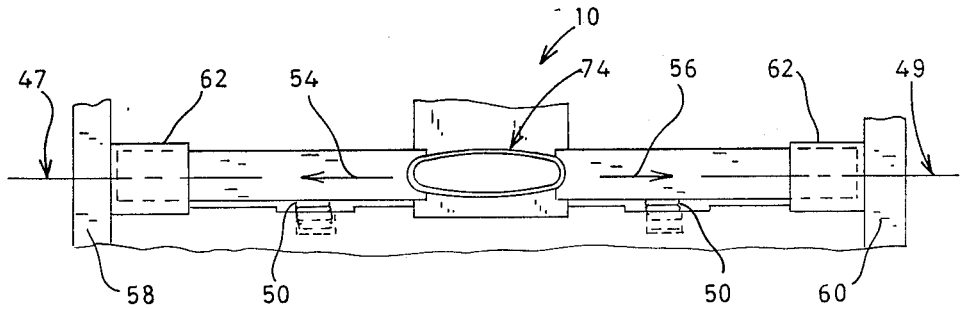
FIG. 5 illustrates an end view of an apparatus for fabricating metal tubing having a generally elliptical shape by cold pressing round tubing stock into the desired shape, constructed in accordance with the various features of the present invention. This figure shows the apparatus as it appears at the point where the round tubing stock has been pressed into the desired shape.

In the preferred embodiment, the second pair of opposing dies 24 and 26 each comprise a plate defining a pair of substantially planar opposing surfaces 32 and 34, a die edge portion 36, a pivot edge portion 38 parallel to and opposite said die edge portion 36, and a pair of end portions 40 and 42 defined by the planar surfaces 32 and 34 and the edge portions 36 and 38. Pivot means are provided for pivoting each of the second pair of dies 24 and 26 about pivot axes 44 and 46, respectively, which are parallel to and proximate the pivot edge portions 38 of each die. It will be understood that the pivot axes indicated by the reference numerals 44 and 46 in FIGS. 4 and 6 do not represent physical objects, but only represent imaginary lines about which the second pair of dies pivot. The reference lines 47 and 49 in FIGS. 4 and 5 are imaginary lines which represent the mid-planes of of the second pair of opposing dies 24 and 26, respectively. The second pair of opposing dies 24 and 26 are positioned on either side and substantially between the first pair of opposing dies 16 and 18 such that the pivot axes 44 and 46 lie in a plane which is perpendicular to the direction of relative movement of the platens 12 and 14 (as indicated by the arrows 48) proximate the stationary platen 14 with the pivot means comprising one or more springs 50 secured between the stationary platen 14 and the dies 24 and 26 proximate the die edge portions 36 of the dies.

Means 52 are provided for securing the second pair of opposing dies 24 and 26 in the above described position such that forces on the opposing dies 24 and 26 which are perpendicular to the pivot axes 44 and 46, i.e. in the direction of the arrows 54 and 56 shown in FIGS. 4 and 5, are absorbed without substantially displacing the dies in such directions. In the illustrated embodiment, the means 52 comprise supports 58 and 60 which are secured to the stationary platen 14 as shown in FIGS. 3–7. End supports 62 are provided proximate the pivot axis sides of the end portions 40 and 42 of the dies 24 and 26 to prevent longitudinal displacement of the dies, i.e. in a direction parallel to the pivot axes 44 and 46.

Figure 3:
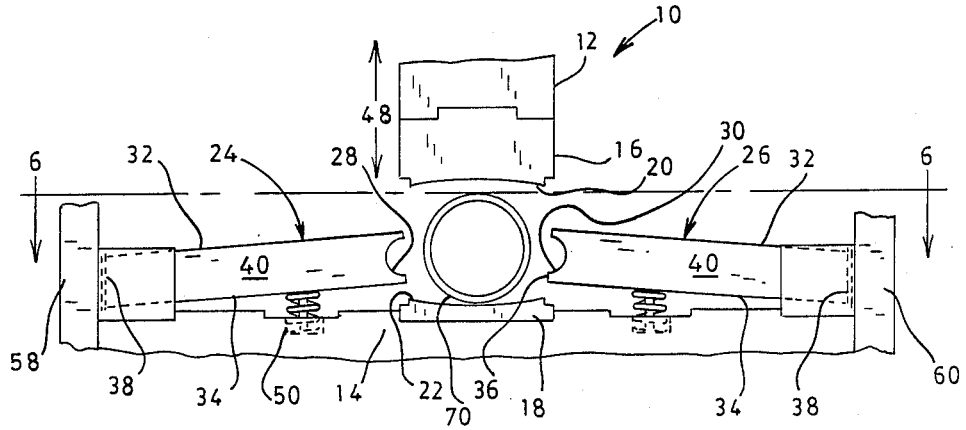
FIG. 3 illustrates an end view of an apparatus for fabricating metal tubing having a generally elliptical shape by cold pressing round tubing stock into the desired shape, constructed in accordance with the various features of the present invention. This figure shows the apparatus as it appears prior to beginning the pressing operation.
Figure 6:
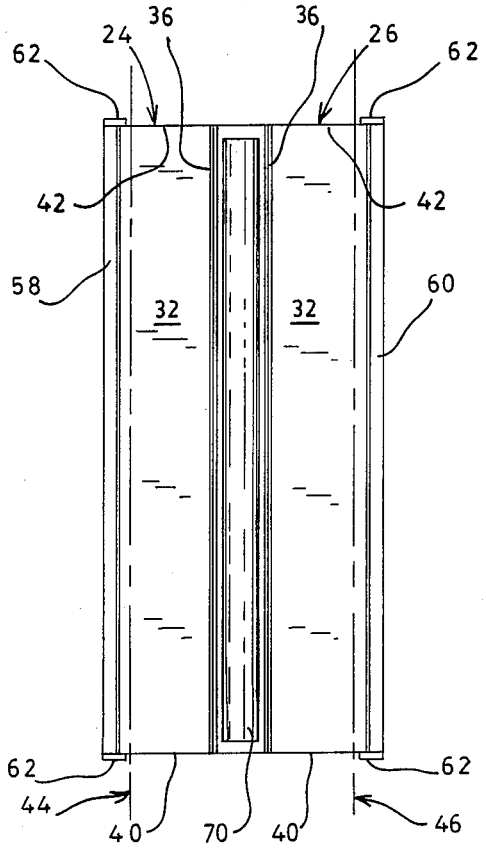
FIG. 6 illustrates an top view, in section, of the apparatus shown in FIG. 3.

The method of the present invention for fabricating tubing having the generally elliptical shape illustrated in FIGS. 1A and 1B comprises the steps of: (1) placing a length of round tubing stock 70 between the first pair of dies 16 and 18 as shown in FIGS. 3 and 6: (2) pressing the tubing stock between the dies 16 and 18 until it takes the general egg-like shape shown at 72 in FIG. 4, i.e. until the tubing is flattened sufficiently to engage the second pair of dies 24 and 26 as shown in FIG. 4: and (3)

positioning the tubing formed in the previous step between the first and second pairs of opposing dies as shown in FIG. 4 and pressing the tubing into the die faces 20 and 22 of the first pair of dies and the die faces 28 and 30 of the second pair of dies as shown in FIG. 5 by operating the press to move the moving platen 12 toward the stationary platen 14. It will be appreciated by those skilled in the art that, in the last step, the tubing engages the die faces 28 and 30 and pivots the second pair of dies toward the stationary platen 14, compressing the springs 50 as shown in FIG. 5. Accordingly, the tubing takes the desired shape shown generally at 74 in FIG. 5. It will be appreciated by those skilled in the art that the first two steps of the above-described method can be accomplished in a press having only the first pair of opposing dies secured to the platens of the press.

Figure 7:
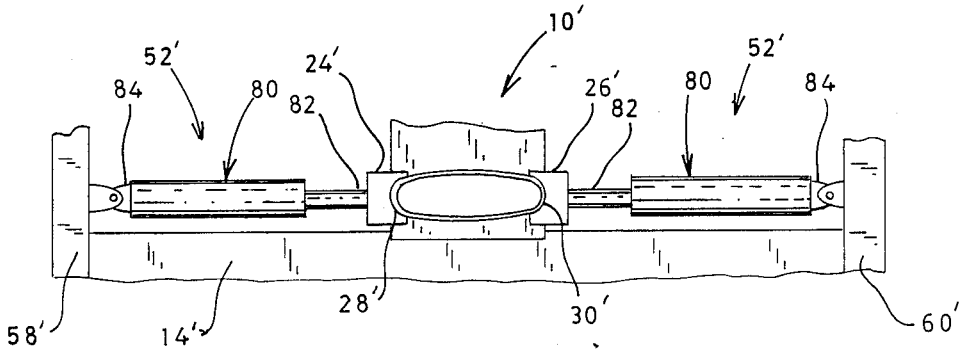
FIG. 7 illustrates an end view of an alternate embodiment 10' of an apparatus for fabricating metal tubing having a generally elliptical shape by cold pressing round tubing stock into the desired shape, constructed in accordance with the various features of the present invention.

Referring now to FIG. 7, an alternate embodiment 10′ of the apparatus of the present invention is illustrated. It will be noted that elements in this figure which are identified by prime reference numerals are analogous to the elements of the apparatus 10, described above and illustrated in FIGS. 3–6, which carry the same but unprimed reference numerals. In the apparatus 10′, an alternate means 52′ for providing a preselected rate of resistance to the lateral movement, i.e. in a direction perpendicular to the direction of relative movement between the first pair of opposing dies, of the second pair of opposing dies 24′ and 26′ is provided. The means 52′ comprises one or more cylinders 80 positioned between the second pair of opposing dies 24′ and 26′ and the supports 58′ and 60′. In the illustrated embodiment, a piston rod end portion 82 of each of the cylinders is secured to one of the dies and a cylinder housing end portion 84 is pivotally secured to the adjacent support 58′ or 60′ in order to pivot the die faces 28′ and 30′ through an arc toward the stationary platen 14′ in a manner similar to that described for the preferred embodiment 10 described above; however, it will be appreciated by those skilled in the art that the cylinder housing end portions 84 could be slidably secured to the supports 58′ and 60′ such that they could only move in a direction parallel to the direction of movement of the platens of the press.

Figure 8:
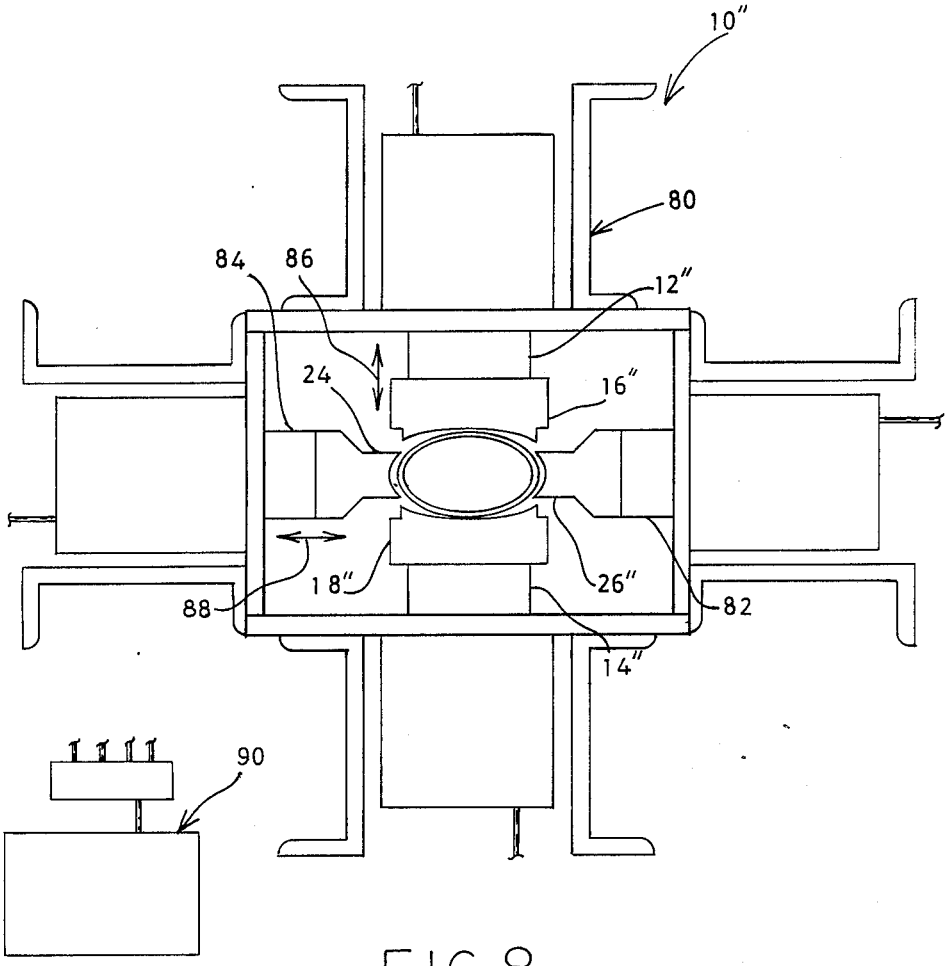
FIG. 8 illustrates a diagrammatic end view of an alternate embodiment 10" of an apparatus for fabricating metal tubing having a generally elliptical shape by cold pressing round tubing stock into the desired shape, constructed in accordance with the various features of the present invention.

Referring now to FIG. 8, another alternate embodiment 10″ of the apparatus of the present invention is illustrated. It will be noted that elements in this figure which are identified by double-prime reference numerals are analogous to the elements of the apparatus 10, described above and illustrated in FIGS. 3–6, which carry the same but unprimed reference numerals. The apparatus 10″ includes a press, shown generally at 85, having two pairs of moveable opposing platens disposed at right angles to one another. The first pair of opposing platens 12″ and 14″ function in a manner similar to the platens 12 and 14 of the press used in conjunction with the apparatus 10 described above inasmuch as they have secured thereto a first pair of opposing dies 16″ and 18″, respectively, having die faces for forming the substantially flattened sides of tubing having a generally elliptical shape. The first pair of opposing platens 12″ and 14″ move in the directions indicated by the arrows 86. A second pair of opposing platens 83 and 87, disposed at right angles to the first pair of platens, are provided which move in the direction indicated by the arrows 88. A second pair of opposing dies 24″ and 26″ having die faces for forming the substantially rounded sides of tubing having a generally elliptical shape are secured to the second pair of opposing platens 83 and 87, respectively. A conventional hydraulic controller 90 is provided for for controlling the pressure supplied to the rams which control the movement of the platens 12″, 14″, 83, and 87 of the press 85, whereby generally round tubing stock can be pressed between the first and second pairs of opposing dies to form tubing of the desired generally elliptical shape.

While a preferred embodiment has been shown and described, it will be understood that it is not intended to limit the invention to such disclosure, but rather it is intended to cover all modifications and alternate constructions falling within the scope of the invention as defined in the appended claims.

I claim:

1. An apparatus for fabricating metal tubing having a generally elliptical cross-section, said generally elliptical tubing having first and second opposing substantially flattened sides and first and second opposing substantially rounded sides joining said first and second, opposing flattened sides, from generally round tubing stock with a press having a pair of opposing platens, said apparatus comprising:

a first pair of opposing dies secured to said opposing platens of said press, said first pair of dies having die faces of preselected shape for forming said first and second opposing substantially flattened sides of said generally elliptical tubing;

a second pair of opposing dies having die faces defining a substantially concave shape for forming said first and second opposing substantially rounded sides of said generally elliptical tubing, said second pair of opposing dies being positioned substantially between and on either side of said first pair of opposing dies such that said die faces of said second pair of opposing dies are engaged by said substantially rounded sides of said generally elliptical tubing when said generally elliptical tubing is pressed between said first pair of opposing dies, said second pair of opposing dies being disposed at substantially right angles to said first pair of opposing dies and movable separately from said first pair of opposing dies; and means for providing a preselected resistance to the movement of said second pair of opposing dies in a direction perpendicular the relative direction of movement of said platens of said press whereby said generally round tubing stock can be pressed between said die faces of said first pair of opposing dies until said tubing stock engages said die faces of second pair of opposing dies thereby pressing said tubing stock into said generally elliptical shape defined by said die faces of said first and second pairs of opposing dies.

2. The apparatus of claim 1 wherein said means for providing a preselected resistance to the movement of said second pair of opposing dies in a direction perpendicular the relative direction of movement of said platens of said press comprises:

at least one cylinder means secured to each of said second pair of opposing dies proximate a first end portion of said cylinder means, a second end portion being secured to a support means fixedly secured to said press;

said cylinder means being substantially perpendicularly disposed to the die face of the die to which it is secured.

3. The apparatus of claim 2 wherein said cylinder means is pivotally secured to said support means proximate its said second end portion.

4. The apparatus of claim 1 wherein said means for providing a preselected resistance to the movement of said second pair of opposing dies in a direction perpendicular the relative direction of movement of said platens of said press comprises:

said press having a second pair of opposing moveable platens positioned substantially between and on either side of said first pair of opposing platens;

said second pair of opposing dies being secured to said second pair of opposing moveable platens such that said die faces of said second pair of opposing dies are engaged by said substantially rounded sides of said tubing when said tubing is pressed between said first pair of opposing dies, said second pair of opposing dies being disposed at substantially right angles to said first pair of opposing dies; and hydraulic control means for controlling the relative movement of said first and second pairs of platens of said press.

5. The apparatus of claim 1 wherein said means for providing a preselected rate of resistance to the movement of said second pair of opposing dies in a direction perpendicular the relative direction of movement of said platens of said press comprises means for pivoting said die faces of said second pair of opposing dies through an arc.

6. The apparatus of claim 5 wherein said means for providing a preselected resistance to the movement of said second pair of opposing dies in a direction perpendicular the relative direction of movement of said platens of said press further comprises:

each of said second pair of opposing dies comprising:

a. a pivotable plate defining a pair of substantially planar opposing surfaces, a die edge portion, a pivot edge portion parallel to and opposite said die edge portion, and a pair of end portions defined by said planar surfaces and said opposite edge portions;

b. means for pivoting said pivotable plate about an axis parallel to and proximate said pivot edge portion; and c. said die edge portion defining a die face having a preselected substantially concave shape for forming said substantially rounded sides of said tubing;

said second pair of opposing dies being positioned on either side of said first pair of opposing dies such that said pivot axes lie in the same plane, said plane being perpendicular to the direction of relative movement of said platens and proximate one of said platens; and means for securing said second pair of opposing dies in said position such that forces on said second pair of opposing dies which are perpendicular to said pivot axes are absorbed without substantially displacing said dies;

whereby tubing stock having preselected cross-sectional dimensions can be pressed between said first pair of opposing dies until said tubing stock engages said second pair of opposing dies thereby pivoting said second pair of dies until their midplanes lie substantially in the same plane, and thereby pressing said tubing stock into the desired said generally elliptical shape defined by the die faces of said first and second pairs of opposing dies.

7. An apparatus for fabricating metal tubing having a generally elliptical cross-sectional shape, said tubing having first and second opposing substantially flattened sides and first and second opposing substantially rounded sides, with a press having a pair of opposing platens, said apparatus comprising:

a first pair of opposing dies secured to said opposing platens of said press and having die faces of preselected shape for forming said first and second opposing substantially flattened sides of said tubing;

a second pair of opposing dies for forming said first and second opposing substantially rounded sides of said tubing;

each of said second pair of opposing dies comprising:

a. a pivotable plate defining a pair of substantially planar opposing surfaces, a die edge portion, a pivot edge portion parallel to and opposite said die edge portion, and a pair of end portions defined by said planar surfaces and said opposite edge portions;

b. means for pivoting said pivotable plate about an axis parallel to and proximate said pivot edge portion; and c. said die edge portion defining a die face having a preselected substantially concave shape for forming said substantially rounded sides of said tubing;

said second pair of opposing dies being positioned on either side of said first pair of opposing dies such that said pivot axes lie in the same plane, said plane being perpendicular to the direction of relative movement of said platens and proximate one of said platens; and means for securing said second pair of opposing dies in said position such that forces on said second pair of opposing dies which are perpendicular to said pivot axes are absorbed without substantially displacing said dies;

whereby tubing stock having preselected cross-sectional dimensions can be pressed between said first pair of opposing dies until said tubing stock engages said second pair of opposing dies thereby pivoting said second pair of dies until their midplanes lie in the same plane, and thereby pressing said tubing stock into the desired said generally elliptical shape defined by the die faces of said first and second pairs of opposing dies.

8. A method for fabricating metal tubing having a generally elliptical cross-sectional shape, said generally elliptical tubing having first and second opposing substantially flattened sides and first and second opposing substantially rounded sides joining said first and second opposing flattened sides, from round tubing stock with a press having a pair of opposing platens, said method comprising the steps of:

positioning a length of said round tubing stock between a first pair of opposing dies secured to said platens and having die faces of preselected shape for forming said first and second opposing substantially flattened sides of said generally elliptical tubing;

pressing said length of round tubing stock between said first pair of opposing dies until said tubing stock engages a second pair of opposing dies positioned substantially between and on either side of said first pair of opposing dies, said second pair of opposing dies having die faces of preselected shape for forming said substantially rounded sides of said generally elliptical tubing, said second pair of opposing dies mounted so as to permit movement in a direction generally perpendicular to movement of said platens;

further pressing said length of round tubing stock between said first and second pairs of opposing dies into said generally elliptical shape defined by said die faces of said first and second pairs of opposing dies; and providing, during said further pressing, a preselected resistance to movement of said second pair of opposing dies in said direction perpendicular to movement of said platens of said press to enhance formation of said generally elliptical shape.

9. An apparatus for fabricating metal tubing having a generally elliptical cross-sectional shape, said tubing having first and second opposing substantially flattened sides and first and second opposing substantially rounded sides, from generally round tubing stock with a press having a pair of opposing platens, said apparatus comprising:

a first pair of opposing dies secured to said opposing platens of said press and having die faces of preselected shape for forming said first and second opposing substantially flattened sides of said tubing;

a second pair of opposing dies having die faces defining a substantially concave shape for forming said first and second opposing substantially rounded sides of said tubing, said second pair of opposing dies being positioned substantially between and on either side of said first pair of opposing dies such that said die faces of said second pair of opposing dies are engaged by said substantially rounded sides of said elliptical tubing when said tubing is pressed between said first pair of opposing dies, said second pair of opposing dies being disposed at substantially right angles to said first pair of opposing dies; and means for providing a preselected resistance to the movement of said second pair of opposing dies in a direction perpendicular the relative direction of movement of said platens of said press, said means for providing preselected resistance to movement including means for pivoting said die faces of said second pair of opposing dies through an arc;

whereby said generally round tubing stock can be pressed between said first pair of opposing dies until said tubing stock engages said second pair of opposing dies thereby pressing said generally round tubing stock into said generally elliptical shape defined by the die faces of said first and second pairs of opposing dies.

* * * * *